US007407243B2

(12) United States Patent
Sadano

(10) Patent No.: US 7,407,243 B2
(45) Date of Patent: Aug. 5, 2008

(54) IMAGE FORMING APPARATUS

(75) Inventor: Kohichi Sadano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 378 days.

(21) Appl. No.: 11/249,988

(22) Filed: Oct. 13, 2005

(65) Prior Publication Data

US 2006/0092241 A1 May 4, 2006

(30) Foreign Application Priority Data

Oct. 29, 2004 (JP) ..... 2004-314942

(51) Int. Cl.
*B41J 2/145* (2006.01)
*G03G 15/00* (2006.01)

(52) U.S. Cl. ..... 347/7; 399/11; 399/81

(58) Field of Classification Search ..... 347/7, 347/19, 23, 85; 358/401, 474; 399/11, 18, 399/37, 81, 162
See application file for complete search history.

(56) References Cited

U.S. PATENT DOCUMENTS

| | | | | | |
|---|---|---|---|---|---|
| 4,875,092 | A * | 10/1989 | Yamanishi et al. | ..... | 358/526 |
| 4,970,549 | A * | 11/1990 | Yoshizuka et al. | ..... | 399/81 |
| 5,103,266 | A * | 4/1992 | Miyamoto et al. | ..... | 399/347 |
| 5,299,021 | A * | 3/1994 | Gartner | ..... | 358/401 |
| 6,597,466 | B1 * | 7/2003 | Katayama | ..... | 358/1.13 |
| 6,862,116 | B2 * | 3/2005 | Ogino | ..... | 358/474 |

FOREIGN PATENT DOCUMENTS

| | | |
|---|---|---|
| JP | 2001-347655 | 12/2001 |
| JP | 2004-98248 | 4/2004 |

* cited by examiner

*Primary Examiner*—Anh T. N. Vo
(74) *Attorney, Agent, or Firm*—Cooper & Dunham, LLP

(57) ABSTRACT

An image forming apparatus whereby recording liquid is jetted onto a recording medium so that an image is formed, the image forming apparatus includes an operations part configured to operate the apparatus in a predetermined special mode different from a normal mode in a case where a machine number stored in advance is a specific character string.

14 Claims, 7 Drawing Sheets

IMAGE FORMING APPARATUS

BACKGROUND

1. Technical Field

The present disclosure relates to image forming apparatuses.

2. Description of the Related Art

A serial scan type or line type image forming apparatus is known as an image forming apparatus such as a printer, facsimile, copier, plotter, printer or multi-purpose functional machine of the printer and the facsimile. The serial scan type or line type image forming apparatus includes an image forming part for jetting a liquid drop of recording liquid onto a recording medium such as a paper so that image forming, such as printing or recording, can be implemented.

For the purpose of improvement of the productivity of such an image forming apparatus, for example, Japan Laid-Open Patent Application Publication No. 2001-347655 discloses that an ink jet head, an IC for driving the ink jet head, and plural electronic parts for driving the ink jet head as the constituent members of this ink jet head module are set on a TAB tape.

In addition, Japan Laid-Open Patent Application Publication No. 2004-98248 discloses the following technologies. That is, by detection information on a reference mark for detecting positions of two kinds of parts detected in a first part position detection process and a second part position detection process, the position of the second part is corrected, and the first part and the second part are pressured and joined. After the pressuring and joining, the position detection reference mark for the two kinds of parts is detected again. By determining positional deviation of the two kinds of parts and performing adjoining inspection, outflow of defective products to a post process is prevented so as to improve total yield.

Meanwhile, when the image forming apparatus is manufactured, checking of the image is implemented so as to guarantee that the manufactured image forming apparatus can provide an image having a designated quality. In a process for checking the image, the image is actually printed and it is determined whether the printed image achieves an expected image quality.

Because of this, while generally the image is output in a normal printing mode so that the check is performed, only operations of a printing function and a maintenance function having influence on the image quality are required to be conducted. Furthermore, in order to reduce the time for checking, it is required to create a state where the image printing can be implemented within a short period of time after the electric power is turned on.

However, the environment of a general user is assumed in the printing mode normally used. Hence, for example, when the electric power is turned on, the following are performed: a paper conveyance operation for ejecting a paper remaining in the apparatus, a supplying operation for supplying ink from a recording liquid cartridge in a case where the remaining amount of liquid in a sub-tank configured to supply the recording liquid to the image forming part (head) configured to jet a liquid drop of the recording liquid is less than a designated amount, and a detecting operation for detecting a foreign body on the conveyance belt configured to convey the paper.

Because of this, since unnecessary operations are conducted for such a check, it takes a lot of time for image checking so that productivity may be degraded.

SUMMARY

In an aspect of the present disclosure, a novel and useful image forming apparatus is provided whereby time required for an image test can be reduced.

In another aspect of the present disclosure, an image forming apparatus is provided whereby recording liquid is jetted onto a recording medium so that an image is formed, the image forming apparatus including: an operations part configured to operate the apparatus in a predetermined special mode different from a normal mode in a case where a machine number stored in advance is a specific character string.

In another aspect of the present disclosure, an image forming apparatus is provided whereby recording liquid is jetted onto a recording medium so that an image is formed, the image forming apparatus including: means for operating the apparatus in a predetermined special mode different from a normal mode in a case where a machine number stored in advance is a specific character string.

In another aspect of the present disclosure, an image forming apparatus is provided whereby recording liquid is jetted onto a recording medium so that an image is formed, the image forming apparatus including: an operations part configured to operate the apparatus in a predetermined special mode different from a normal mode in a case where an input is implemented by a predetermined specific key operation at an operation panel.

In another aspect of the present disclosure, an image forming apparatus is provided whereby recording liquid is jetted onto a recording medium so that an image is formed, the image forming apparatus including: means for operating the apparatus in a predetermined special mode different from a normal mode in a case where an input is implemented by a predetermined specific key operation at an operations panel.

In another aspect of the present disclosure, an image forming apparatus is provided whereby recording liquid is jetted onto a recording medium so that an image is formed, the image forming apparatus including: an operations part configured to operate the apparatus in a predetermined special mode different from a normal mode in a case where an external connection part is connected to a connector.

In another aspect of the present disclosure, an image forming apparatus is provided whereby recording liquid is jetted onto a recording medium so that an image is formed, the image forming apparatus including: means for operating the apparatus in a predetermined special mode different from a normal mode in a case where an external connection part is connected to a connector.

According to the above-mentioned aspect of the invention, the image forming apparatus includes an operations part configured to operate the apparatus in a predetermined special mode different from a normal mode in a case where i) a machine number stored in advance is a specific character string, ii) an input is implemented by a predetermined specific key operation at an operation panels; or iii) an external connection part is connected to a connector. Hence, it is possible to avoid unnecessary operations for image checking so as to reduce the time for the image check.

Other objects, features, and advantages of the present invention will become more apparent from the following detailed description when read in conjunction with the accompanying drawings.

DETAILED DESCRIPTION OF PREFERRED EMBODIMENTS

A description of examples and exemplary embodiments of the present disclosure is now given, with reference to FIG. 1 through FIG. 8.

Figure 1:
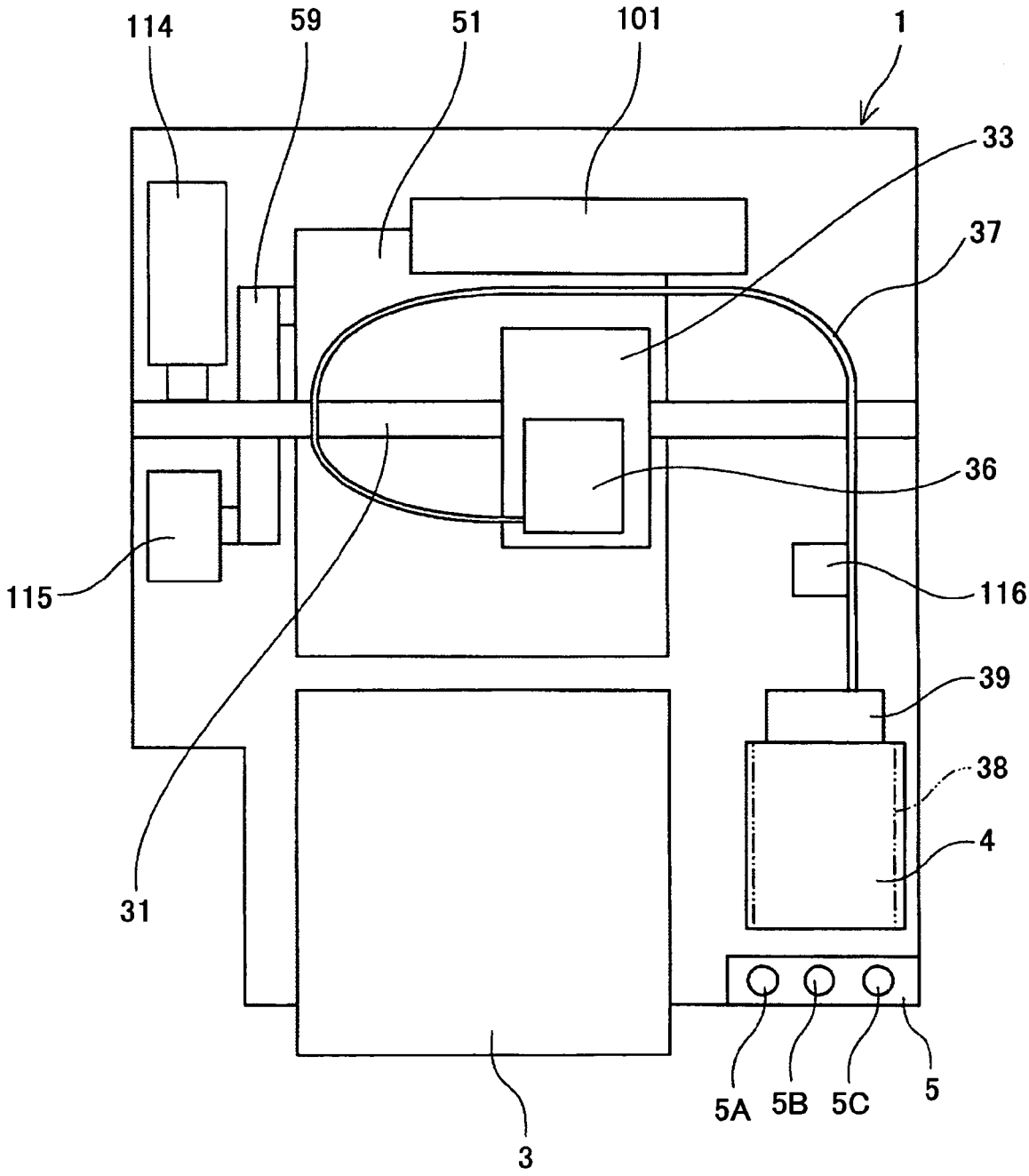
FIG. 1 is a structural diagram of an inkjet recording apparatus, which is an example of an image forming apparatus according a first embodiment of the present invention.
Figure 2:
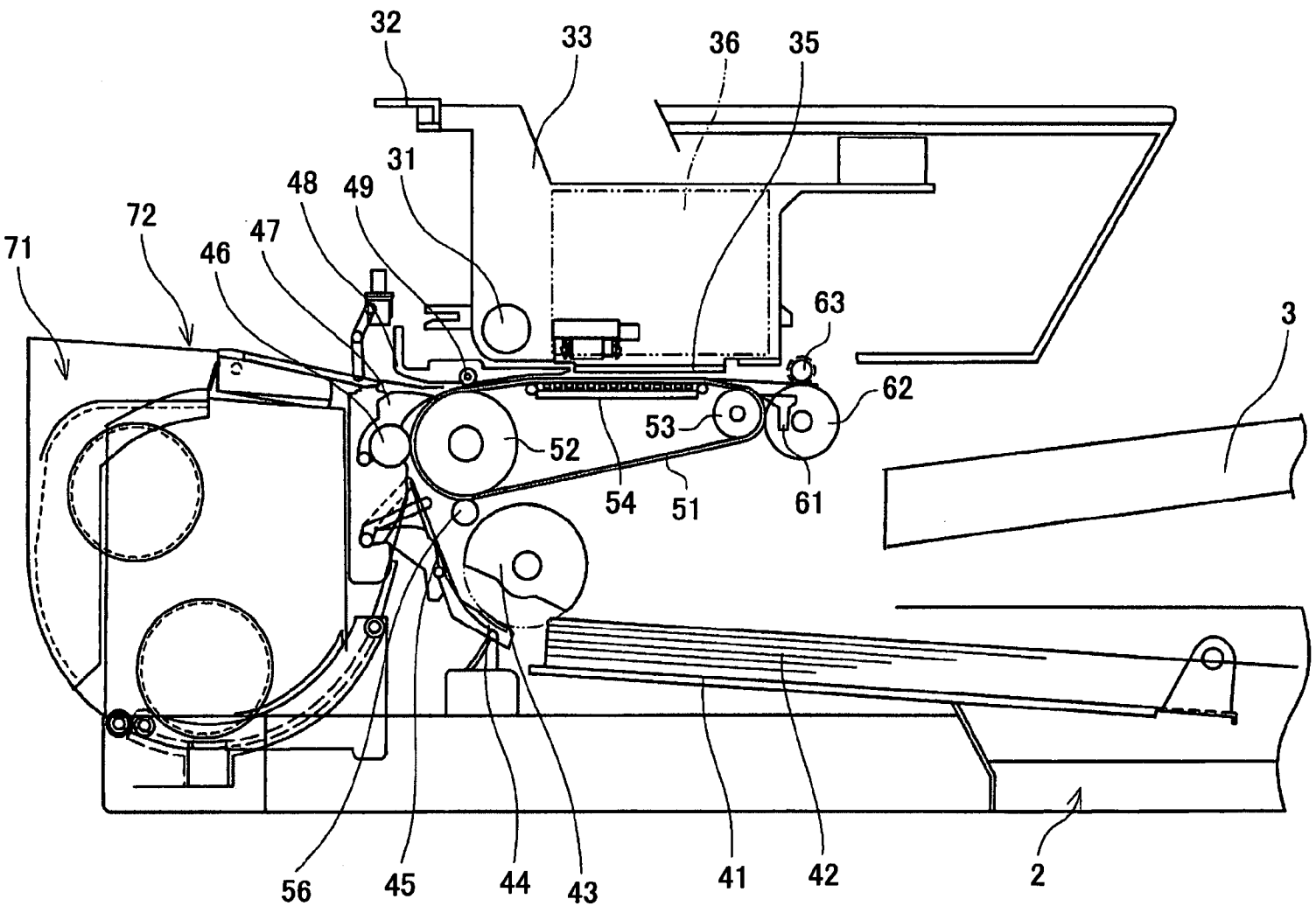
FIG. 2 is a side view of the inkjet recording apparatus shown in FIG. 1.
Figure 3:
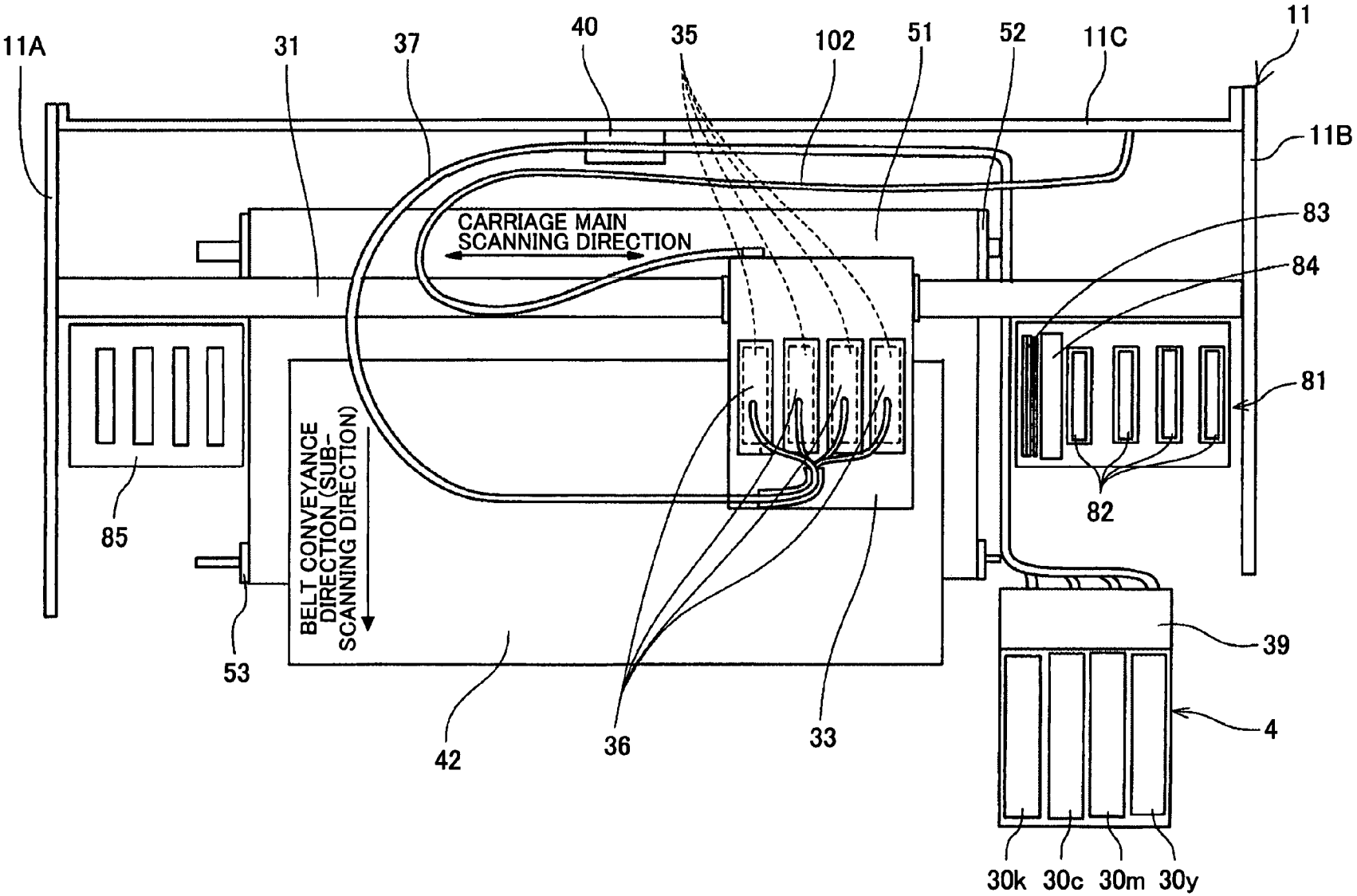
FIG. 3 is a plan view of a main part of the inkjet recording apparatus shown in FIG. 1.

FIG. 1 is a structural diagram of an inkjet recording apparatus, which is an example of an image forming apparatus according a first embodiment of the present invention. FIG. 2 is a side view of the inkjet recording apparatus shown in FIG. 1. FIG. 3 is a plan view of a main part of the inkjet recording apparatus shown in FIG. 1.

At a front surface side of the image forming apparatus 1, a paper supply cassette 2 where papers are provided, a paper eject tray 3 in which the paper where the image is recorded (formed) is provided, a cartridge installation part 4 where an ink cartridge that is a recording liquid cartridge is detachably provided, and an operations panel 5 including a switch for giving a designated instruction to the image forming apparatus and a display part displaying a remaining amount of fluid in the ink cartridge are provided. An image forming mechanism part for forming an image is provided inside of the image forming apparatus.

The image forming mechanism part includes a guide rod 31 and a stay 32 that together slide-ably support a carriage 33, which is movable in directions of arrows (carriage main-scanning direction) in FIG. 3 by being driven by a main-scanning motor 114. The guide rod 31 and the stay 32 are guide members bridging between left and right side plates 11A and 11B.

The carriage 33 is provided with a recording head 35 having four inkjet heads, which eject ink droplets of yellow (Y), cyan (C), magenta (M) and black (Bk) so that plural ink outlet ports of the recording head 35 are arranged along a direction perpendicular to the main-scanning direction and the ink droplets are ejected in a downward direction.

The inkjet head constituting the recording head 35 may be of a piezoelectric actuator type using a piezoelectric element, a thermal actuator type using a phase change caused by film boiling of a liquid by an electrothermal transforming element, a shaped memory alloy actuator type using metal phase change caused by a temperature change, an electrostatic actuator type using an electrostatic force, etc.

A driver IC is provided at the recording head 35. The recording head 35 is connected to a control circuit board 101 via a harness (flexible print cable) 102.

Sub-tanks 36 for each color are mounted on the carriage 33 so as to supply ink of each color to the recording head 35. Ink is supplied to each of the sub-tanks 36 from a main tank (ink cartridge 38 (30*k*, 30*c*, 30*m*, and 30*y*)) through ink supply tubes.

A supply pump unit 39 for sending ink provided in the ink cartridge 38 is provided at the cartridge installation 4. An ink supply tube 37 is supported at a back plate 11*c* forming the frame 11 by a receiving member 40.

A paper feed part, which feeds recording papers 42 placed on a paper placement part 41 of the paper supply cassette 2, comprises a woodruff roller (feed roller) 43 and a separation pad 44 that is urged toward the feed roller 43. The feed roller 43 separates and feeds the recording papers 42 from the paper placement part 41 on an individual recording paper basis. The separation pad 44 is made of a material having a high coefficient of friction.

Additionally, there is provided, as a conveyance part for conveying the recording papers 42 fed from the paper feed part under the recording head 35, a conveyance belt 51, a counter roller 46, a conveyance guide 47, and an end press roller 49. The conveyance belt 51 conveys the recording papers 42 by attaching thereto by an electrostatic force.

The conveyance belt 51 is an endless belt, which is engaged with a conveyance roller 52 and a tension roller 53 so as to be rotated in an in-belt conveyance direction (sub-scanning direction). The conveyance belt 51 has a front layer and a back layer. The front layer is formed by a pure resin material, which has not been subjected to a resistance control process and has a thickness of about 40 μm, such as, for example, an ETFE pure material. The front layer serves as a paper attracting surface. The back layer is formed of the same material as the front layer but is subjected to a resistance control process by the addition of carbon. The back layer may serve as an intermediate resistance layer or a grounding layer.

The charge roller 56 is brought into contact with the conveyance belt 51 so as to be rotated by the movement of the conveyance belt 51. The charge roller 56 has applied a pressing force of 2.5 N at each end of an axis thereof. The conveyance roller 52 also serves as a grounding roller, which is brought into contact with the intermediate resistance layer (back layer) of the conveyance belt 51.

A guide member 54 is located on the backside of the conveyance belt 51 corresponding to a print area by the recording head 35. An upper surface of the guide member 54 protrudes toward the recording head 35 from a tangential line of the two rollers (the conveyance roller 52 and the tension roller 53) that support the conveyance belt 51. Accordingly, the conveyance belt 51 is lifted and guided by the upper surface of the guide member 54 in the print area.

The conveyance belt 51 is moved by driving the conveyance roller 52 with the sub-scanning motor 115 via the driving belt 59.

Furthermore, there are provided, as a paper eject part for ejecting the recording papers 42 recorded on by the recording head 35, a separation part 61 for separating each recording paper 43 from the conveyance belt 51, paper eject rollers 62 and 63, and the paper eject tray 3 for accommodating the ejected recording papers 42.

Additionally, a double-side paper feed unit 71 is detachably attached to a backside of the apparatus 1. The double-side paper feed unit 71 takes each recording paper 42 returned by reverse rotation of the conveyance belt 51 and turns over the returned recording paper 42, and feeds the recording paper 42 to a position between the counter roller 46 and the conveyance belt 51. A manual tray 72 is provided at the upper surface of the double-side paper feed unit 71.

As shown in FIG. 3, a mechanism 81 for maintaining and recovering is provided in a non-printing area at one side in a scanning direction of the carriage 33 so as to maintain and recover a state of a nozzle of the recording head 35. The mechanism 81 for maintaining and recovering includes a capping member 82 for capping nozzle surfaces of the recording head 35, a wiper blade 83 for wiping the nozzle surface, and a primary jet receiving part 84 for receiving a liquid drop not contributing to image recording. A primary jet receiving part 85 for receiving a liquid drop not contributing to image recording is arranged in a non-printing area at the other side in a scanning direction of the carriage 33.

In the inkjet recording apparatus having the above-mentioned structure, each recording paper 42 is separated and fed from the paper supply part 2, each recording paper 42 being fed upward in a vertical direction is guided by the guide 45, each recording paper 42 is conveyed while being sandwiched between the conveyance belt 51 and the counter roller 46, and, then, the end of each recording paper 42 is guided by the conveyance guide 47 and pressed against the conveyance belt 51 by the end press roller 49 so as to change the direction of conveyance by about 90 degrees.

At this time, an alternating voltage is applied to the charge roller 56 from an AC bias supply part provided at a control circuit 101 (not shown) so that a positive output and a negative output are repeatedly applied to the charge roller 56. Thus, the conveyance roller 51 is charged in an alternating charge voltage pattern so that plus and minus charges are alternately arranged in the sub-scanning direction, which is the rotational direction of the conveyance belt 51. When the recording paper 42 is fed onto the conveyance belt 51, which is charged in the alternating plus and minus pattern, polarization charging occurs in the recording paper 42 so as to form charges opposite to the charge pattern of the conveyance belt 51. Thereby, the recording paper 42 is conveyed by the conveyance belt 51 rotating in the sub-scanning direction.

Thus, recording of one line is performed by ejecting ink droplets onto the recording paper 42, when the recording paper 42 is stopped, by driving the recording head 35 in accordance with image signals while moving the carriage 33, and, then, recording a next line is performed after conveying the recording paper 42 by a predetermined distance. Upon receipt of a recording end signal or a signal which indicates that a trailing edge of the recording paper 42 has reached the recording area, the recording operation is ended, and the recording paper 42 is ejected onto the paper eject tray 3.

Figure 4:
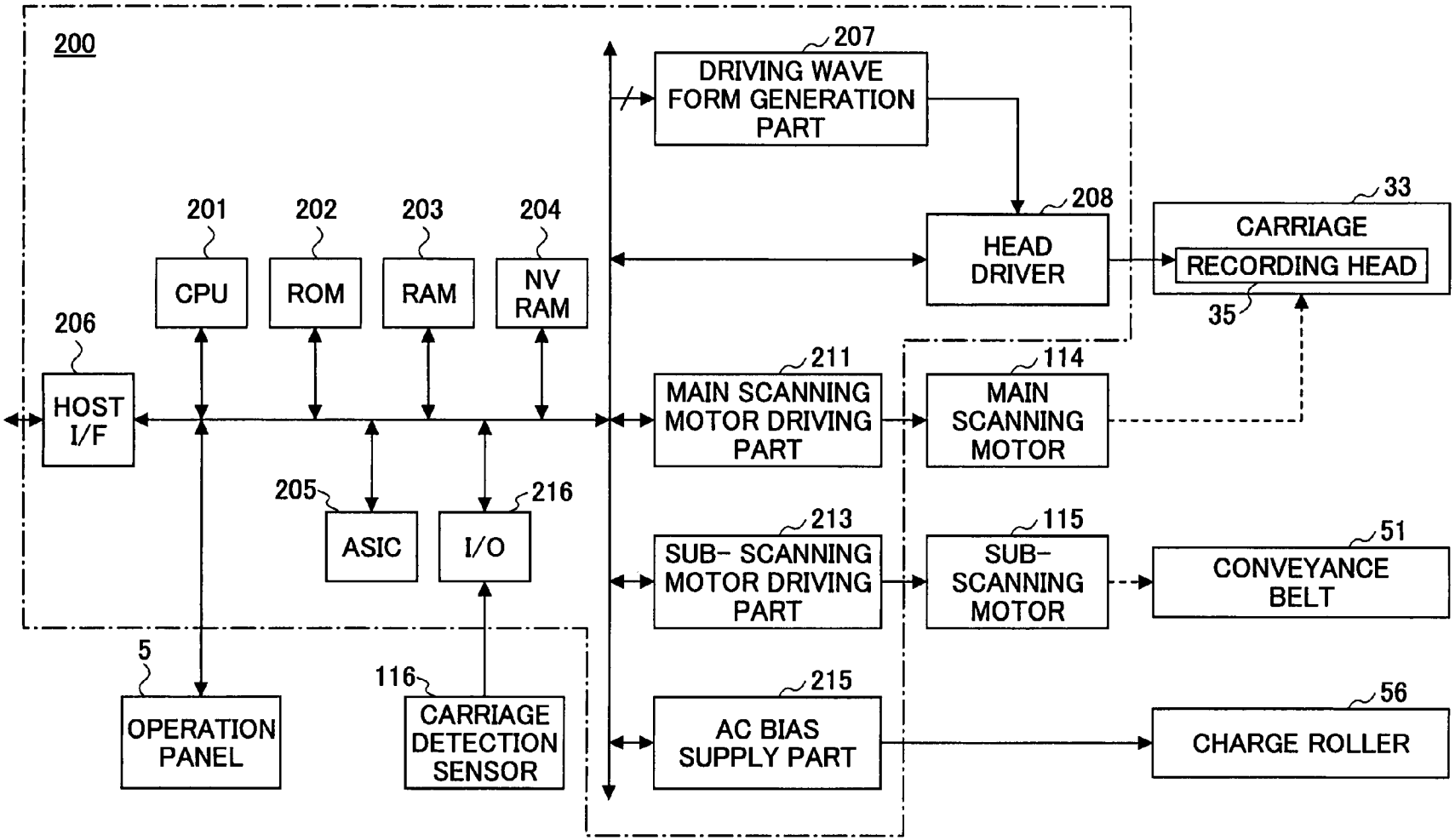
FIG. 4 is a block diagram of the entire control part of the inkjet recording apparatus shown in FIG. 1.

Next, a description is now given with reference to FIG. 4 of a control part of the inkjet recording apparatus. FIG. 4 is a block diagram of the entire control part of the inkjet recording apparatus shown in FIG. 1.

A control part 200 is mounted on a control circuit board 101. The control part 200 includes a CPU 201 for controlling the entire apparatus, a ROM 202 storing a program implemented by the CPU 201 and other fixed data, a RAM 203 storing the image data for a while, a nonvolatile memory (NVRAM) 204 for holding data even when the electric power is cut off, an ASIC 205 for processing various signals for the image data, processing the image such as change of the arrangement, or processing input/output signals for the entire apparatus.

In addition, the control part 200 includes an I/F 206 for transmitting/receiving data or signals to/from a host side, namely an image processing apparatus or data processing apparatus such as a personal computer, a driving wave forming generating part 207 for generating a driving wave form for driving the recording head 35, a head driver 208 for driving and controlling the recording head 35, a main scanning motor driving part 211 for driving the main scanning motor 114, a sub-scanning motor driving part 213 for driving the sub-scanning motor 115, an AC bias supplying part 215 for supplying an AC bias voltage to the charge roller 56, an I/O 216 for inputting a detection signal from various sensors such as a carriage detection sensor 116 for detecting a home position of the carriage 33 shown in FIG. 1, and others. The carriage detection sensor 116 is, for example, a photo sensor. It is possible to determine whether the carriage 33 is situated at a standard position by detecting a position of a filler material provided in the carriage 33 via the carriage detection sensor 116. A switch and a display of the operations panel 5 are connected to the control part 200.

In the control part 200, printing data including image data from the host side such as the image processing apparatus (for example, the personal computer), the image reading apparatus (for example, an image scanner), a photographing apparatus (for example, a digital camera) or the like, are received by the I/F 206 via a cable or network.

The CPU 201 reads out and analyzes the printing data in the receiving buffer included in the I/F 206. A necessary image process or a change of the arrangement of the data is implemented so that the image data are transferred to the head driver 208. A generation of dot pattern data for outputting an image may be implemented by storing font data in the ROM 202, for example, or by developing the image data to bit map data by using the printer driver at the host side so as to be transferred to this apparatus.

The driving wave form generation part 207 includes a D/A converter for D/A converting pattern data of a driving pulse. The driving wave form generation part 207 outputs a driving wave form corresponding to pattern data of the driving pulse to the head driver 208.

The head driver 208 drives the recording head 35 by selectively applying a driving pulse forming a driving wave form given from the driving wave form generation part 207 based on serially input image data (dot pattern data) corresponding to one line of the recording head 35 to an actuator part of the recording head 35.

Operational contents of a normal mode and a special mode in the image forming apparatus are discussed with reference to FIG. 5.

Figure 5:
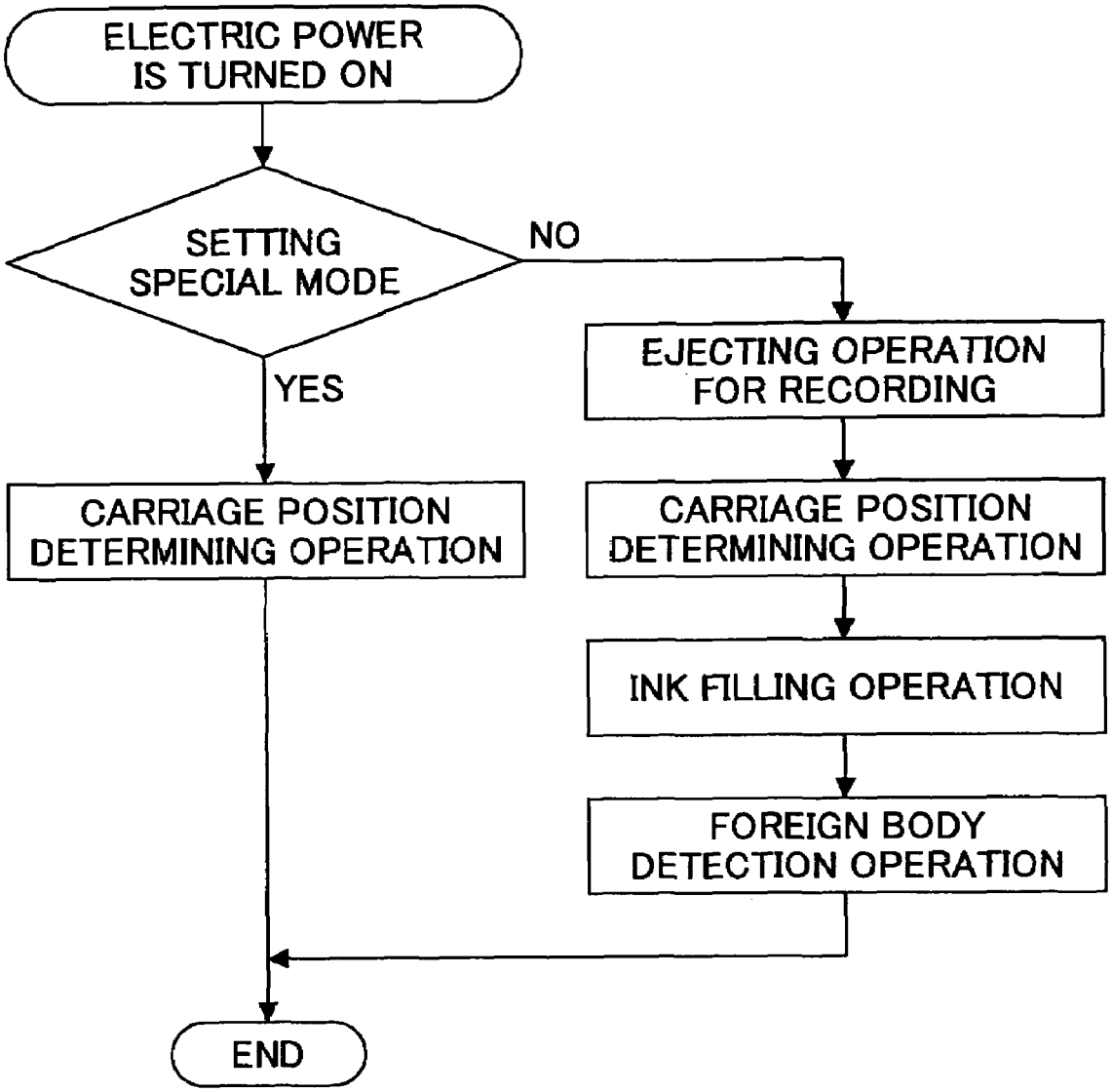
FIG. 5 is a flowchart for explaining operational contents of a normal mode and a special mode in the image forming apparatus.

FIG. 5 is a flowchart for showing a process of an initial operation implemented when the electric power is turned on. In the initial operational process, first, whether the operating mode is to be a normal mode wherein the same operation as the normal operation is done or a special mode wherein an operation different from the normal operation is done is determined.

In the normal mode, the conveyance belt 151 is moved by driving the sub-scanning motor 115 so that the papers 42 remaining in the apparatus 1 are ejected.

Then, the main scanning motor 114 is driven so that the carriage 33 is moved in a home position direction until the carriage 33 is stopped. After the carriage 33 is stopped, based on a detection signal of the carriage position detection sensor 116, a filler provided in the carriage 33 is detected by the carriage position detection sensor 116 so that a carriage position determination operation for determining whether the stopped position of the carriage 33 is normal is determined. In the carriage position determination operation, if the stopped position of the carriage 33 is determined to be abnormal, an error indication is made on the operations panel 5.

If the stopped position of the carriage 33 is normal, in a case where the amount of ink consumed that is counted by processing at the control part 200 is more than a designated amount, an ink supply pump 39 is driven so that an ink filling process is performed wherein ink is supplied from a main ink cartridge 38 to the sub-tank 36.

After that, the carriage 33 is moved in a printing area direction so that the position where the carriage 33 is stopped is detected. Whether an area width where the carriage 33 can be moved is smaller than a designated width is determined based on the detection result. In a case where the area width where the carriage 33 can be moved is smaller than the designated width, it is regarded that a foreign body is situated on the conveyance belt 51 so that a foreign body detection operation for indicating an error on the operations panel 5 is implemented.

On the other hand, in the special mode, only the carriage position determination operation is implemented and the paper ejecting operation, the ink filling operation, and the foreign body detection operation are not implemented.

Figure 6:
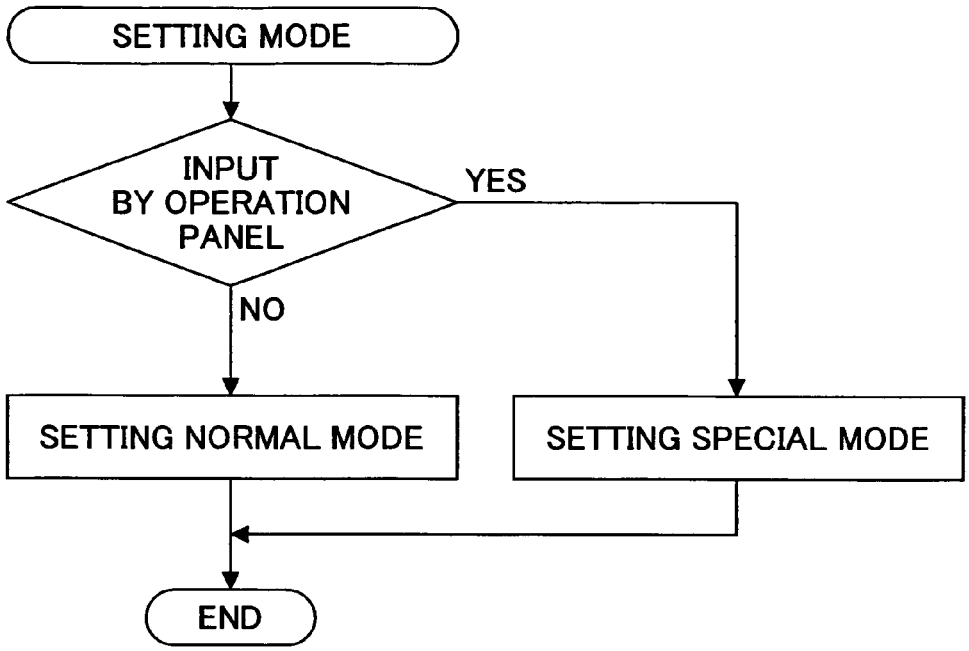
FIG. 6 is a flowchart for explaining setting processes of the normal mode and the special mode in the image forming apparatus.

Examples of processes of the normal mode and the special mode are discussed with reference to FIG. 6.

In this example, when an electric power button (switch) 5A provided on the operations panel 5 is turned on, whether all of other buttons 5B and 5C other than the electric power button (switch) 5A are simultaneously pushed, that is, whether input of a specific key operation is implemented, is determined.

When the electric power button (switch) 5A provided on the operation panel 5 is turned on, if all of other buttons 5B and 5C other than the electric power button (switch) 5A are simultaneously pushed, it is regarded that the special mode is designated so that a setting for operating in the special mode is done. If only the electric power button (switch) 5A is turned on, operations are done in the normal mode.

Thus, when the predetermined specific key operation is done by the operations panel, the apparatus is operated in the predetermined special mode different from the normal mode to omit an operation done in the normal mode. In the case of the image check process, the apparatus is operated in the special mode so that the time from turning on the electric power to a state where the printing can be done can be drastically shortened as compared with the normal mode. Hence, it is possible to reduce the time for checking the image and to reduce cost for manufacturing the image forming apparatus.

In this case, the time from turning on the electric power to a state where the printing can be done can be drastically shortened as compared with the normal mode, by setting at least one of the paper ejecting operation (operation for ejecting a recording medium remained in the apparatus), the ink filling operation of the recording liquid from the recording liquid cartridge to the sub-tank, and the detection operation of the foreign body situated on the conveyance belt, as operation in the normal mode, to be omitted in the case of the operation in the special mode.

Figure 7:
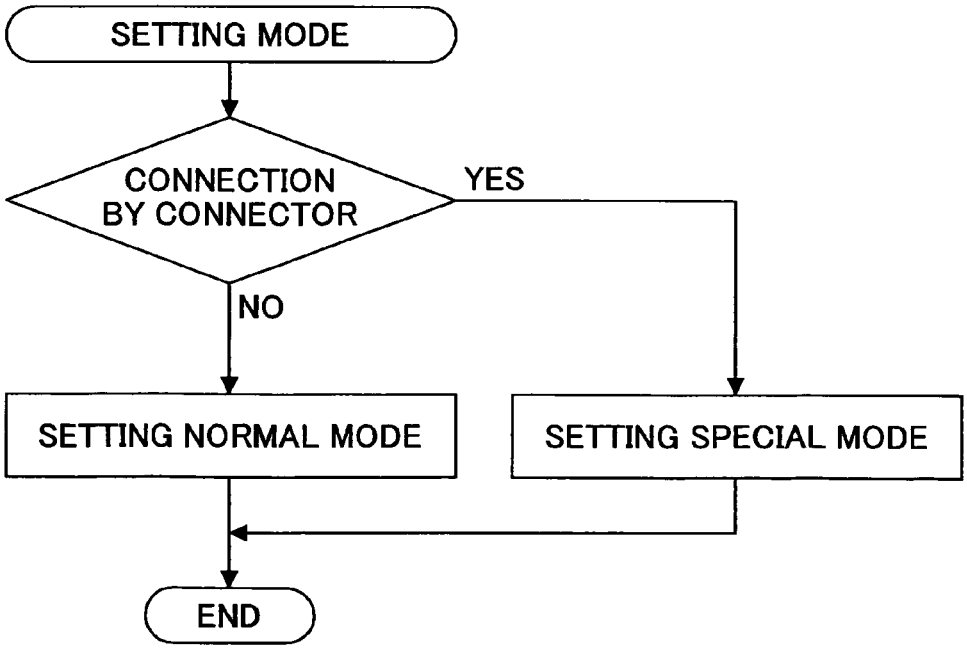
FIG. 7 is a flowchart for explaining setting processes of a normal mode and a special mode in a second embodiment of the present invention.

Next, setting processes of the normal mode and the special mode in another embodiment of the present invention are discussed with reference to FIG. 7.

In this embodiment, when the electric power is turned on, whether a connection part (cable) is connected to a connecter (not shown) provided on the control circuit board 101 is determined. In a case where the connection part is connected to the connecter, the special mode is designated so that an operation in the special mode is set. In a case where the connection part is not connected to the connecter, an operation in the normal mode is set.

In this embodiment as well as the above embodiment, the time from turning on the electric power to a state where the printing can be done can be drastically shortened as compared with the normal mode. In addition, the key operation of the operations panel is not necessary. Only connection of the cable to the connecter is required and therefore it is easy to designate the special mode.

Figure 8:
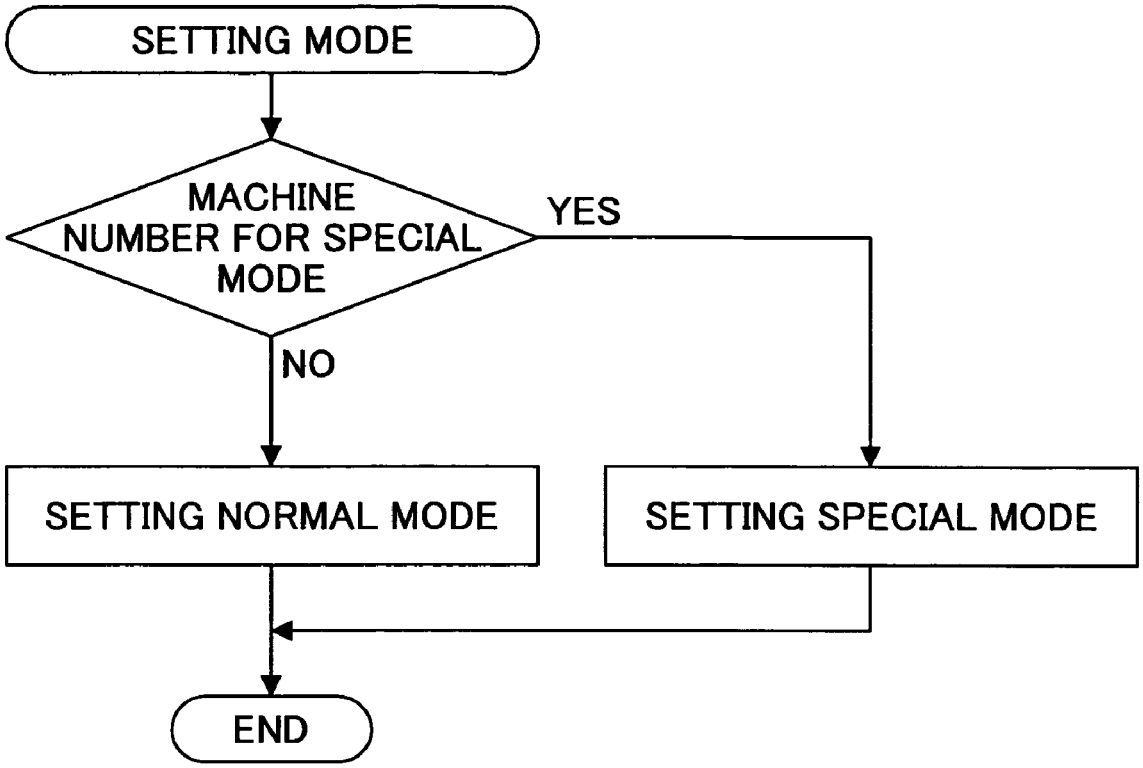
FIG. 8 is a flowchart for explaining setting processes of a normal mode and a special mode in a third embodiment of the present invention.

Next, setting processes of the normal mode and the special mode in another embodiment of the present invention are discussed with reference to FIG. 8.

In this embodiment, when the electric power is turned on, whether a machine number stored in the ROM 201 of the control part 200 in advance is a specific character string such as "temp" is determined.

In a case where the machine number is the specific character, the special mode is designated so that an operation in the special mode is set. In a case where the machine number is not the specific character, an operation in the normal mode is set.

In this embodiment as well as the above-mentioned embodiments, the time from turning on of the electric power to a state where the printing can be done can be drastically shortened as compared with the normal mode. In addition, the key operation of the operations panel is not necessary. Only input of the specific character in advance is required until the completion of the checking process and therefore it is easy to designate the special mode.

The present invention is not limited to the above-discussed embodiments, but variations and modifications may be made without departing from the scope of the present invention.

This disclosure is based on Japanese Priority Patent Application No. 2004-314942 filed on Oct. 29, 2004, the entire contents of which are incorporated here in by reference.

What is claimed is:

1. An image forming apparatus whereby recording liquid is jetted onto a recording medium so that an image is formed, the image forming apparatus comprising:

an operations part configured to operate the apparatus in a predetermined special mode different from a normal mode in a case where a machine number stored in advance is a specific character string; and a sub-tank configured to supply the recording liquid to an image forming part configured to jet the recording liquid from a recording liquid cartridge detachably connected to the apparatus;

wherein a filling operation of the recording liquid from the recording liquid cartridge to the sub-tank is implemented in a case where an electric power supply is turned on in the normal mode, and the filling operation of the recording liquid from the recording liquid cartridge to the sub-tank is not implemented in a case where an electric power supply is turned on in the special mode.

2. The image forming apparatus as claimed in claim 1, wherein the recording medium remaining in the apparatus is ejected in a case where an electric power supply is turned on in the normal mode, and the recording medium remaining in the apparatus is not ejected in a case where an electric power supply is turned on in the special mode.

3. An image forming apparatus whereby recording liquid is jetted onto a recording medium so that an image is formed, the image forming apparatus comprising:

an operations part configured to operate the apparatus in a predetermined special mode different from a normal mode in a case where an input is implemented by a predetermined specific key operation at an operation panel; and a sub-tank configured to supply the recording liquid to an image forming part configured to jet the recording liquid from a recording liquid cartridge detachably connected to the apparatus;

wherein a filling operation of the recording liquid from the recording liquid cartridge to the sub-tank is implemented in a case where an electric power supplies turned on in the normal mode, and the filling operation of the recording liquid from the recording liquid cartridge to the sub-tank is not implemented in a case where an electric power supply is turned on in the special mode.

4. An image forming apparatus whereby recording liquid is jetted onto a recording medium so that an image is formed, the image forming apparatus comprising:

an operations part configured to operate the apparatus in a predetermined special mode different from a normal mode in a case where an external connection part is connected to a connector; and a sub-tank configured to supply the recording liquid to an image forming part configured to the recording liquid from a recording liquid cartridge detachably connected to the apparatus;

Wherein a filling operation of the recording liquid from the recording liquid cartridge to the sub-tank is implemented in a case where an electric power supply is turned on in the normal mode;

and the filling operation of the recording liquid from the recording liquid cartridge to the sub-tank is not implemented in a case where an electric power supply is turned on in the special mode.

5. An image forming apparatus whereby recording liquid is jetted onto a recording medium so that an image is formed, the image forming apparatus comprising:

means for operating the apparatus in a predetermined special mode different from a normal mode in a case where an input is implemented by a predetermined specific key operation at an operations panel; and a sub-tank configured to supply the recording liquid to an image forming part configured to jet the recording liquid from a recording liquid cartridge detachably connected to the apparatus;

wherein a filling operation of the recording liquid from the recording liquid cartridge to the sub-tank is implemented in a case where an electric power supply is turned on in the normal mode, and the filling operation of the recording liquid from the recording liquid cartridge to the sub-tank is not implemented in a case where an electric power supply is turned on in the special mode.

6. An image forming apparatus whereby recording liquid is jetted onto a recording medium so that an image is formed, the image forming apparatus comprising:

means for operating the apparatus in a predetermined special mode different from a normal mode in a case where an external connection part is connected to a connector; and a sub-tank configured to supply the recording liquid to an image forming part configured to jet the recording liquid from a recording liquid cartridge detachably connected to the apparatus;

wherein a filling operation of the recording liquid from the recording liquid cartridge to the sub-tank is implemented in a case where an electric power supply is turned on in the normal mode, and the filling operation of the recording liquid from the recording liquid cartridge to the sub-tank is not implemented in a case where an electric power supply is turned on in the special mode.

7. An image forming apparatus whereby recording liquid is jetted onto a recording medium so that an image is formed, the image forming apparatus comprising:

means for operating the apparatus in a predetermined special mode different from a normal mode in a case where a machine number stored in advance is a specific character string; and a sub-tank configured to supply recording liquid to an image forming part configured to the recording liquid from a recording liquid cartridge detachably connected to the apparatus;

wherein a filling operation of the recording liquid from the recording liquid cartridge to the sub-tank is implemented in a case where an electric power supply is turned on in the normal mode, and the filling operation of the recording liquid from the recording liquid cartridge to the sub-tank is not implemented in a case where an electric power supply is turned on in the special mode.

8. The image forming apparatus as claimed in claim 7, wherein the recording medium remaining in the apparatus is ejected in a case where an electric power supply is turned on in the normal mode, and the recording medium remaining in the apparatus is not ejected in a case where an electric power supply is turned on in the special mode.

9. An image forming apparatus whereby recording liquid is jetted onto a recording medium so that an image is formed, the image forming apparatus comprising:

an operations part configured to operate the apparatus in a predetermined special mode different from a normal mode in a case where a machine number stored in advance is a specific character string, and a conveyance belt configured to convey the recording medium;

wherein a detection operation of a foreign body on the conveyance belt is implemented in a case where an electric power supply is turned on in the normal mode, and the detection operation of a foreign body on the conveyance belt is not implemented in a case where the electric power supply is turned on in the special mode.

10. An image forming apparatus whereby recording liquid is jetted onto a recording medium so that an image is formed, the image forming apparatus comprising:

an operations part configured to operate the apparatus in a predetermined special mode different from a normal mode in a case where an input is implemented by a predetermined specific key operation at an operation panel, and a conveyance belt configured to convey the recording medium;

wherein a detection operation of a foreign body on the conveyance belt is implemented in a case where an electric power supply is turned on in the normal mode, and the detection operation of a foreign body on the conveyance belt is not implemented in a case where the electric power supply is turned on in the special mode.

11. An image forming apparatus whereby recording liquid is jetted onto a recording medium so that an image is formed, the image forming apparatus comprising:

an operations part configured to operate the apparatus in a predetermined special mode different from a normal mode in a case where an external connection part is connected to a connector; and a conveyance belt configured to convey the recording medium;

wherein a detection operation of a foreign body on the conveyance belt is implemented in a case where an electric power supply is turned on in the normal mode, and the detection operation of a foreign body on the conveyance belt is not implemented in a case where the electric power supply is turned on in the special mode.

12. An image forming apparatus whereby recording liquid is jetted onto a recording medium so that an image is formed, the image forming apparatus comprising:

means for operating the apparatus in a predetermined special mode different from a normal mode in a case where a machine number stored in advance is a specific character string; and a conveyance belt configured to convey the recording medium;

wherein a detection operation of a foreign body on the conveyance belt is implemented in a case where an electric power supply is turned on in the normal mode, and the detection operation of a foreign body on the conveyance belt is not implemented in a case where the electric power supply is turned on in the special mode.

13. An image forming apparatus whereby recording liquid is jetted onto a recording medium so that an image is formed, the image forming apparatus comprising:

means for operating the apparatus in a predetermined special mode different from a normal mode in a case where an input is implemented by a predetermined specific key operation at an operations panel; and a conveyance belt configured to convey the recording medium;

wherein a detection operation of a foreign body on the conveyance belt is implemented in a case where an electric power supply is turned on in the normal mode, and the detection operation of a foreign body on the conveyance belt is not implemented in a case where the electric power supply is turned on in the special mode.

14. An image forming apparatus whereby recording liquid is jetted onto a recording medium so that an image is formed, the image forming apparatus comprising:

means for operating the apparatus in a predetermined special mode different from a normal mode in a case where an external connection part is connected to a connector; and a conveyance belt configured to convey the recording medium;

wherein a detection operation of a foreign body on the conveyance belt is implemented in a case where an electric power supply is turned on in the normal mode, and the detection operation of a foreign body on the conveyance belt is not implemented in a case where the electric power supply is turned on in the special mode.

* * * * *